United States Patent [19]

Wanzl et al.

[11] Patent Number: 4,472,908

[45] Date of Patent: Sep. 25, 1984

[54] AUTOMATIC GATE

[75] Inventors: Rudolf Wanzl, Leipheim; Karl Ertle, Langenau; Peter Bischof, Günzburg, all of Fed. Rep. of Germany

[73] Assignee: Rudolf Wanzl KG, Leipheim, Fed. Rep. of Germany

[21] Appl. No.: 422,849

[22] Filed: Sep. 24, 1982

[30] Foreign Application Priority Data

| | | | |
|---|---|---|---|
| Sep. 25, 1981 | [DE] | Fed. Rep. of Germany | 3138201 |
| Oct. 5, 1981 | [DE] | Fed. Rep. of Germany | 8129110[U] |
| Oct. 21, 1981 | [DE] | Fed. Rep. of Germany | 3141749 |
| Aug. 2, 1982 | [DE] | Fed. Rep. of Germany | 3228777 |

[51] Int. Cl.[3] ..... E05F 15/20

[52] U.S. Cl. ..... 49/25; 49/49; 49/141; 49/334

[58] Field of Search ..... 49/25, 49, 46, 47, 141, 49/140, 139

[56] References Cited

U.S. PATENT DOCUMENTS

| | | | |
|---|---|---|---|
| 4,155,199 | 5/1979 | Rubertus | 49/49 X |
| 4,186,521 | 2/1980 | Hunter | 49/334 X |
| 4,232,484 | 11/1980 | Buchmann | 49/49 X |
| 4,290,230 | 9/1981 | t'Kint de Roodenbeke | 49/49 |

FOREIGN PATENT DOCUMENTS

| | | | |
|---|---|---|---|
| 2746896 | 4/1979 | Fed. Rep. of Germany | 49/46 |
| 951636 | 4/1949 | France | 49/25 |
| 1424330 | 2/1979 | United Kingdom | 49/49 |

*Primary Examiner*—Kenneth Downey

*Attorney, Agent, or Firm*—Karl F. Ross; Herbert Dubno

[57] ABSTRACT

An automatic gate arrangement has a hollow and tubular lower post part defining an upright post axis and fixed to one side of the path, an upper end wall transverse to the post axis, and lower fasteners releasably securing the upper end wall to the lower post part. A support fixed to the upper end wall extends upward along the post axis therefrom and pivotally supports a gate shaft at the post axis. A reversible drive motor fixed on and underneath the upper end wall in the lower post part has a rotary output extending through the upper end wall. A transmission between the rotary output and the shaft converts rotation of the output into oscillation about the post axis of the shaft. A C-shaped gate projects laterally from the post axis and is secured to the shaft by connecting means for joint rotation about the post axis unless the gate and shaft are relatively rotated about the post axis with a force exceeding a predetermined maximum force. A controller connected to the motor includes a proximity sensor upstream along the path from the post parts for operating the motor and oscillating the gate when a person is detected by the sensor. A hollow and tubular middle post part above the lower post part, centered on the post axis in axial alignment with the lower post part, and carried on the gate pivots therewith about the post axis. A hollow and tubular upper post part above the middle post part is centered on the post axis in axial alignment with the lower and middle parts. A rigid strut is fixed to the lower post part and support and lower fasteners secure the upper post part to the strut for relatively fixing the upper and lower post parts together.

22 Claims, 11 Drawing Figures

AUTOMATIC GATE

FIELD OF THE INVENTION

The present invention relates to an automatic gate arrangement. More particularly this invention concerns such an arrangement that opens automatically to control passage along a path.

BACKGROUND OF THE INVENTION

An automatic gate arrangement, such as described in German utility model No. 8,107,649, has a noncontacting proximity detector such as an electric eye that operates a side-swinging gate. A post of generally cylindrical shape has fixed upper and lower parts separated by a middle part of which the normally C-shaped gate is carried. An electric motor in the post is connected through an appropriate transmission to the middle part to pivot it about the upright post axis so as to oscillate the gate between a closed position across the path and an open position parallel to it. To prevent injury there is a slip coupling interconnecting the middle part or gate to the drive so that, if an excessive force is extended against the gate or pivoting of the gate is blocked with such a force, the gate can move independently of the drive.

Typically the gate structure itself is quite complex. It is welded together from a multiplicity of pieces and must be perfectly aligned for proper functioning. Any misalignment will in the long run damage the gate mechanism. Such welded construction is expensive and complex. In addition it makes subsequent servicing quite difficult, and leaves corrosion-prone weld spots on the outside of the post.

The final assembly of the gate mechanism must be by means of screws which invariably protrude or are recessed at the locations where they pass through the cylindrical outer wall of the post,. Thus the appearance of the column is not good, since the protruding regions can catch on clothing and the recessed regions become filled with dirt.

OBJECTS OF THE INVENTION

It is therefore an object of the present invention to provide an improved automatic gate arrangement.

Another object is the provision of such an automatic gate arrangement which overcomes the above-given disadvantages.

A further object is to provide an automatic gate arrangement which is easy to manufacture and service, yet which is neat and attractive in appearance.

SUMMARY OF THE INVENTION

These objects are attained according to the instant invention in an automatic gate arrangement which has a hollow and tubular lower post part defining an upright post axis and fixed to one side of the path, an upper end wall transverse to the post axis, and lower fasteners releasably securing the upper end wall to the lower post part to upwardly close same. A support fixed to the upper end wall extends upward along the post axis therefrom and pivotally supports a gate shaft at the post axis. A reversible drive motor fixed on and underneath the upper end wall in the lower post part has a rotary output extending through the upper end wall. Transmission means between the rotary output and the shaft converts rotation of the output into oscillation about the post axis of the shaft. A gate projects laterally from the post axis and is secured to the shaft by connecting means for joint rotation about the post axis unless the gate and shaft are relatively rotated about the post axis with a force exceeding a predetermined maximum force, a so-called panic override that prevents the gate from crushing someone and that allows the gate to be forced open if necessary. Control means connected to the motor includes a proximity sensor upstream along the path from the post parts for operating the motor and oscillating the gate when a person is detected by the sensor. A hollow and tubular middle post part above the lower post part, centered on the post axis in axial alignment with the lower post part, and carried on the gate pivots therewith about the post axis. A hollow and tubular upper post part above the middle post part is centered on the post axis in axial alignment with the lower and middle parts. A rigid strut is fixed to the lower post part and support and lower fasteners secure the upper post part to the strut for relatively fixing the upper and lower post parts together.

Thus the system of this invention can be assembled relatively easily, especially when according to this invention the fasteners are all screw fasteners. These screws and bolts are all inside the tubular post parts so that they are not visible or accessible from the outside.

According to this invention the support has a lower end provided with a flange secured to the upper end wall. In addition the middle part has a lower web formed with a throughgoing hole fitting snugly over the shaft and an upper part similarly fitted over the shaft above the lower web and being rotationally connected thereto by the connecting means. Thus the middle part carrying the gate can be slipped down over the upstanding shaft and will need no further mounting, being held in place axially when the upper part is fixed via the strut to the lower part.

This strut according to the invention is a bracket having a lower bracket end bolted to the support and an upper bracket end connected by the upper fasteners to the upper part. It can also be an arm unitarily formed with the support, or a bracket having a lower bracket end bolted to the upper end wall and an upper bracket end connected by the upper fasteners to the upper part. In any case the upper part has a removable top wall. The removable top wall allows the upper fasteners that secure the top part in place to be exposed so that the upper part can be removed. Once the upper part is off the middle part with the gate can be slipped off. The lower fasteners are thus revealed making it possible to remove the entire motor-transmission assembly carried on the top wall of the lower part.

This upper part, or at least the removable portion of it is according to this invention at least partially transparent and the upper part is provided with a lamp for internal illumination. A circular plastic lens forming the entire upper surface of the upper part can be this lens to shed a pleasant light that plainly identifies the post. This entire lens can be screwed off to change the bulb or gain access to the upper fasteners for servicing of the gate mechanism.

According to another feature of this invention the transmission means includes a lever block projecting radially from the shaft and having a slot open radially outward from the post axis, an eccentric crank on the rotary output engaged in the slot, and an abutment radially fixed relative to the motor output and engageable by same in oscillatory end positions thereof. This crank drive therefore can use a crank orbiting at a constant speed to produce a sinusoidally increasing and decreasing oscillation speed in the gate and middle part.

In addition the motor output rotates about a motor axis generally parallel to the post axis and the eccentric is centered on an eccentric axis parallel to and offset from the motor and post axes. The eccentric axis form substantially perpendicular planes with the motor and post axes in its end positions so that it bears radially of the post axis on the abutment. This abutment is formed by a lower-end projection on the shaft.

To prevent the gate from moving when the motor is deenergized in either end position of the crank the system has means for releasably retaining the eccentric in the end positions with spring force. A simple ball catch will effectively hold the gate in place, unless of course it is pushed with a force exceeding the panic coupling's limit.

In order to allow the gate mechanism to be adapted to circumstances, that is to work on either side of a path or to close rather than open, the shaft is shaped to receive the lever block in any of a plurality of angularly offset positions and the block has a block fastener to fix itself on the shaft in any of the offset positions. Typically four such positions will allow the post to be accommodated to all normal circumstances, since the gate moves through 90° between its end positions.

The motor is of the nonshorting stoppable type, normally being a squirrel-cage motor having no commutators on its rotor so that if the middle part is arrested or comes to its end position while the motor is still running it will not burn out.

The connecting means for panic decoupling of the gate includes a detent displaceable radially but not angularly on the middle part relative to the post axis toward and away from the shaft, spring means radially urging the detent toward the shaft with a predetermined biasing force, and a formation on the shaft interfittable with the detent. The formation and detent inhibit rotation of the shaft relative to the middle part with a force generally proportional to the biasing force. Normally the detent has a head formed with inclined flanks that engage against corresponding faces of a groove in the shaft, with the flanks and faces extending nonradially so that relative rotation of the detent and shaft cam the detent outward against its spring force.

For neatest assembly while permitting adjustment of the panic decoupling threshold force, the middle part is formed with a bore extending radially of the post axis and the detent is displaceable along the bore. The middle part has at least one stub extending radially of the post axis and the gate has a tube arm fitted over the stub with the bore formed in this stub. The spring means includes an abutment in the bore radially displaceable and outside the detent, at least one spring braced radially inward against the detent and radially outward against the detent, and a screw extending through the stub and bearing radially inward on the abutment. Thus the C-shaped gate can be removed and this screw moved in to increase the panic-release force threshold or out to decrease it.

The proximity sensor according to this invention has means including a light source directed across the path from one lateral side thereof for casting a beam across the path, a reflector facing across the path from the other lateral side thereof and intercepting and reflecting the beam of the light source, and a light sensor on the one side of the path receiving the reflected beam. Electronic time-delay circuits are provided to ensure operation of the motor for long enough for full opening and closing of the gate.

DESCRIPTION OF THE DRAWING

The above and other features and advantages will become more readily apparent from the following, reference being made to the accompanying drawing in which.

SPECIFIC DESCRIPTION

Figure 1:
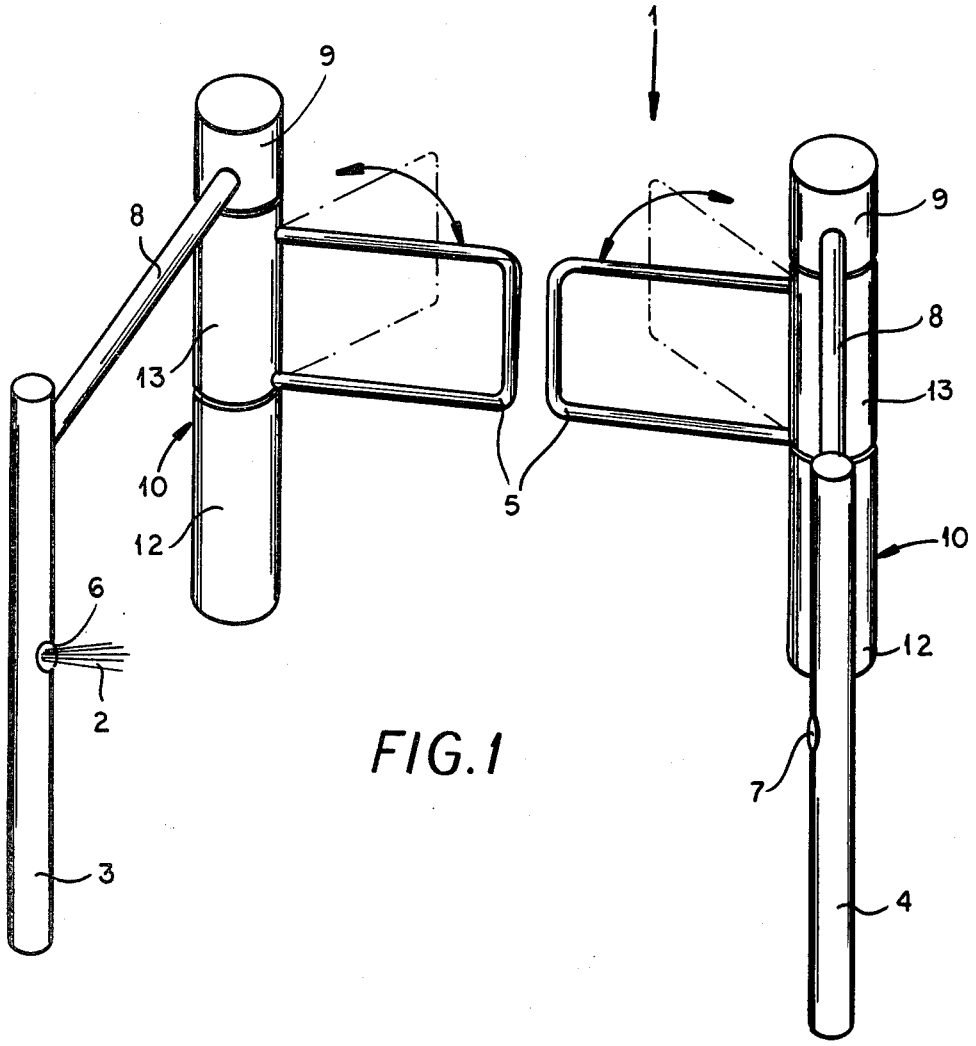
FIG. 1 is a perspective view of a gate arrangement according to this invention.

As seen in FIGS. 1–4, a gate arrangement 1 according to this invention has a pair of symmetrically identical gate posts 10 extending along spaced vertical axes 14 to either side of a path and each having a cylindrical base part 12 fixed in the ground, a cylindrical middle portion 13 carrying a C-shaped gate 5 and pivotal about the respective axis 14, and a cylindrical upper part 9. Each gate 5 lies in a plane including the axis 14 of the respective post 10 and can swing through 90° from the solid-line position of FIG. 1 transverse to and blocking the path and through the dot-dash position of FIG. 1 to a position parallel to and unblocking the path. Extending back upstream parallel to the path flanked by the posts 10 are upper rails 8 having downstream ends connected to the respective upper parts or caps 9 and upstream ends connected to the upper ends of control and reflecting posts 3 and 4 parallel to the posts 10. The control post 3 has an electric-eye sensor arrangement 6 that generates a beam 2 reflected by a mirror 7 on the post 4 to control swinging of the gates 5.

Figure 2:
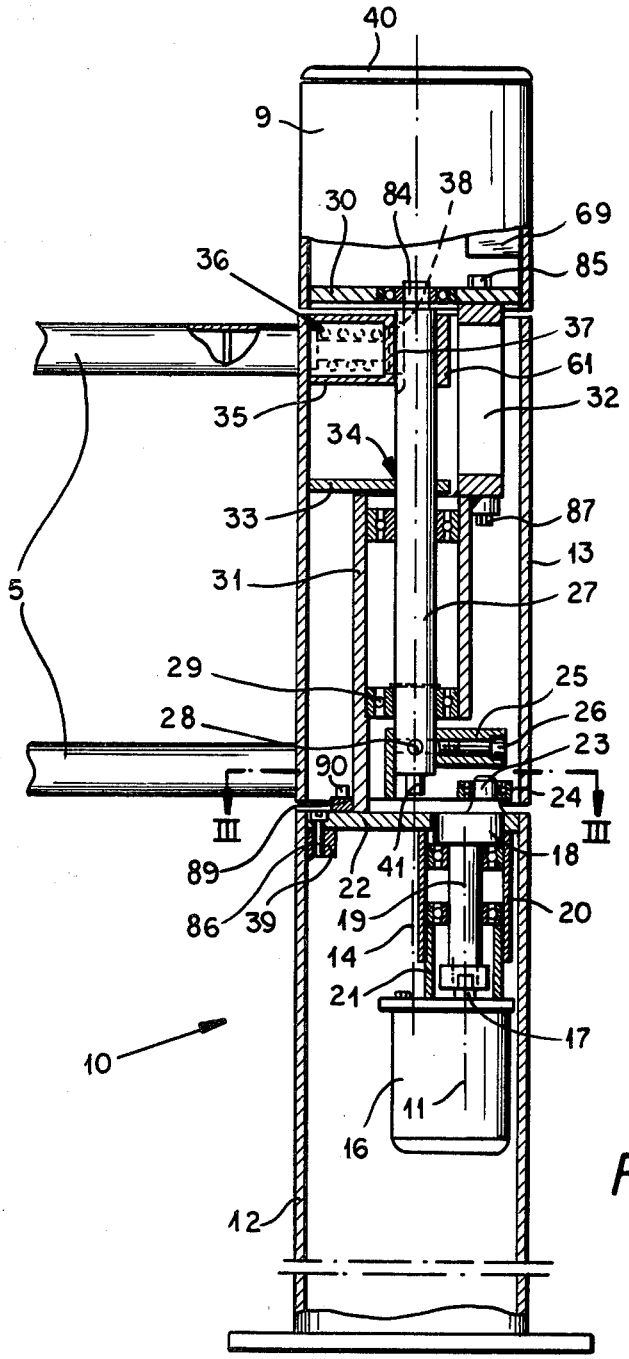
FIG. 2 is a side and partly sectional view of the gate mechanism of the arrangement of FIG. 1.

The lower part 12 of each post 10 as seen in FIG. 2 has a transverse and circular upper wall 22 fitting within its upper end and secured by screws 86 to lugs 39 welded inside this part 12. A tubular bearing support 20 is fixed to the lower surface of the wall 22 and extends downward therefrom along an axis 11 parallel to but spaced from the axis 14. A reversible squirrel-cage motor 16 has a rotary output shaft 17 centered on the axis 11 and a tubular mounting flange 21 that fits within the support flange 20 and is held in place with screws so that the shaft 17 and flanges 20 and 21 are coaxial. A shaft 19 journaled by bearings in the tube 20 at the axis 11 and has a lower end fitted over a square-section end of the shaft 17 and an upper end 18 provided with an eccentric pin 23 carrying a roller bearing 24 and centered on an axis 15 parallel to but offset from the axis 11. The motor 16 can therefore rotate the shaft 12 to orbit the pin 12 and its axis 15 about the axis 11. The spacing between the axes 11 and 15 is the same as the spacing between the axes 11 and 14.

Figure 3:
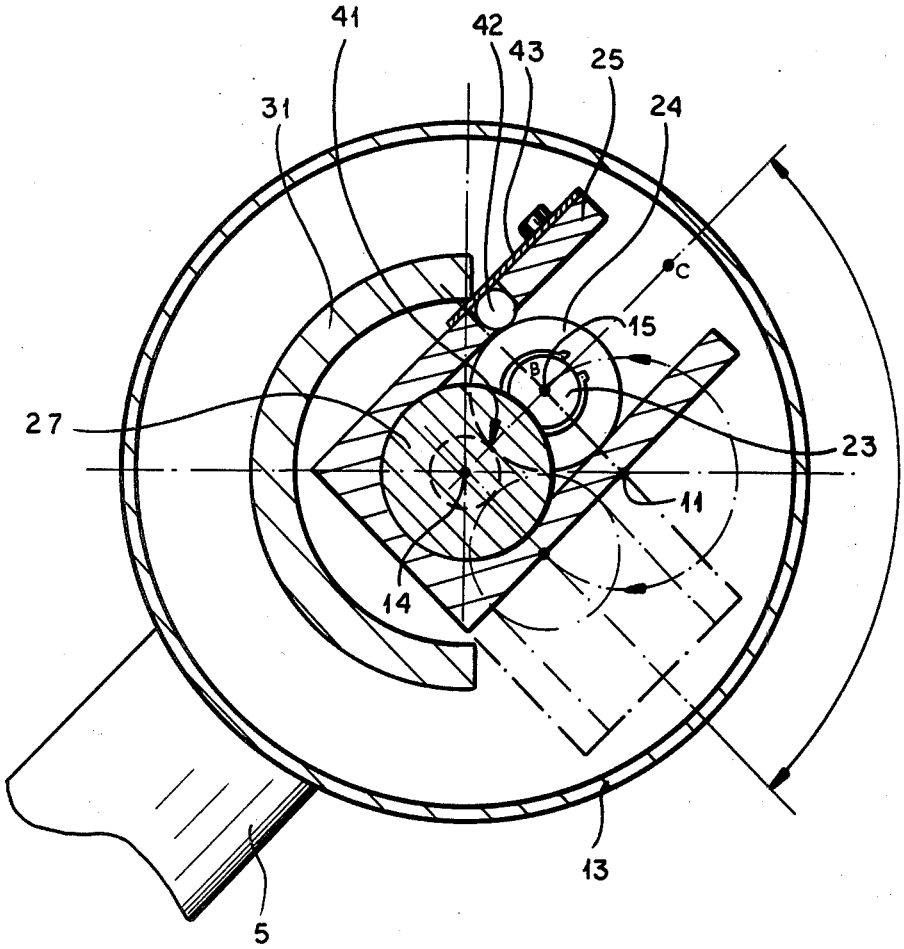
FIG. 3 is a section taken along line III—III of FIG. 2.

A gate support tube 31 has a lower end formed with a flange 89 secured by welding or by bolts 90 to the upper surface of the wall 22. This support tube 31 is centered on the axis 14 and provided with bearings 29 supporting a gate shaft 27 at this axis 14 for rotation thereabout. The lower end of this shaft 27 has a downward projection 41 of reduced diameter and axially level with the roller bearing 24. In addition this lower end carries immediately above the projection 41 a lever block 25 which is secured to it by a screw 26 that can fit in any of four radially open and angularly equispaced holes 28 on it, so that this block 25 can be mounted at any of four angularly offset positions on the shaft 27. The block 27 as seen in FIG. 3 forms a radially outwardly open groove or throat that snugly receives the bearing 24. The radial dimensions of the bearing 24 and extension 41 and the spacing of the axes 11 and 14 are such that as the bearing 24 is orbited at constant speed through 270° about the axis 11 it will move out of and back into a position radially engaging the extension 41 and the shaft 27 will be pivoted through 90° at a speed that increases and decreases sinusoidally during the 270° orbiting of the bearing 24.

In the two end positions, one of which is shown in FIG. 3, whereas FIG. 2 shows the arrangement in an intermediate position after 135° orbiting, the bearing 24 bears perfectly radially on the extension 41, that is the plane of the axes 11 and 15 is perpendicular to the plane of the axes 14 and 15. In this position rotation of the shaft 27 in either direction is positively impeded by the crank mechanism. A ball 42 under the force of a leaf spring 43 is provided to retain the bearing 24 in these end positions so that even if the motor 16 is deenergized rotation of the shaft 27 from either end position is prevented. Normally the circuit that operates the motor 16 does so for a period slightly longer than needed for a three-quarters revolution to ensure movement fully into the end positions. Use of a squirrel-cage motor that merely heats up somewhat when arrested while under power allows such overrunning without damage.

The shaft 27 carries the middle part 13 of the post 10 and the gate 5 extending from it. To this end the tubular middle part has a transverse flange or web 33 formed with a circular hole 34 fitted snugly around the shaft 23 immediately above the support tube 31. In addition a tubular part 35 extending inward in the middle part 13 is formed with a cylindrical eye 61 surrounding the upper end of the shaft 27. This eye 61 is axially confined between two snap rings 62 (FIG. 7) on the shaft 27 which is formed with an axially extending and radially outwardly outwardly open groove 38. A detent arrangement 36 has a detent tooth 37 urged into radial engagement in this groove 38 to rotationally couple the shaft 27 and gate 5, as will be described in more detail below with reference to FIGS. 7–9.

The upper part 9 of the post 10 has a bottom wall 30 perpendicular to the axis 14 and welded in place and a removable translucent top wall 40 constituted as a lens. A socket 69 in the upper part 9 holds a bulb that can illuminage this lens 40 from underneath. The upper end of the shaft 27 has an extension 84 centrally supported by a bearing in the wall 30. A bracket 32 extends axially adjacent the shaft 27 and has a lower end secured by bolts 87 to the top of the support tube 31 and an upper end secured by bolts 85 through the wall 30 to the top part 9. Access is had to this last-mentioned bolt 85 by unscrewing the cover 40. Thus there need be no screw heads exposed on the outer surface of the three parts 9, 12, and 13 on the posts 10. This results in a very easy-to-clean and attractive appearance.

Figure 7:
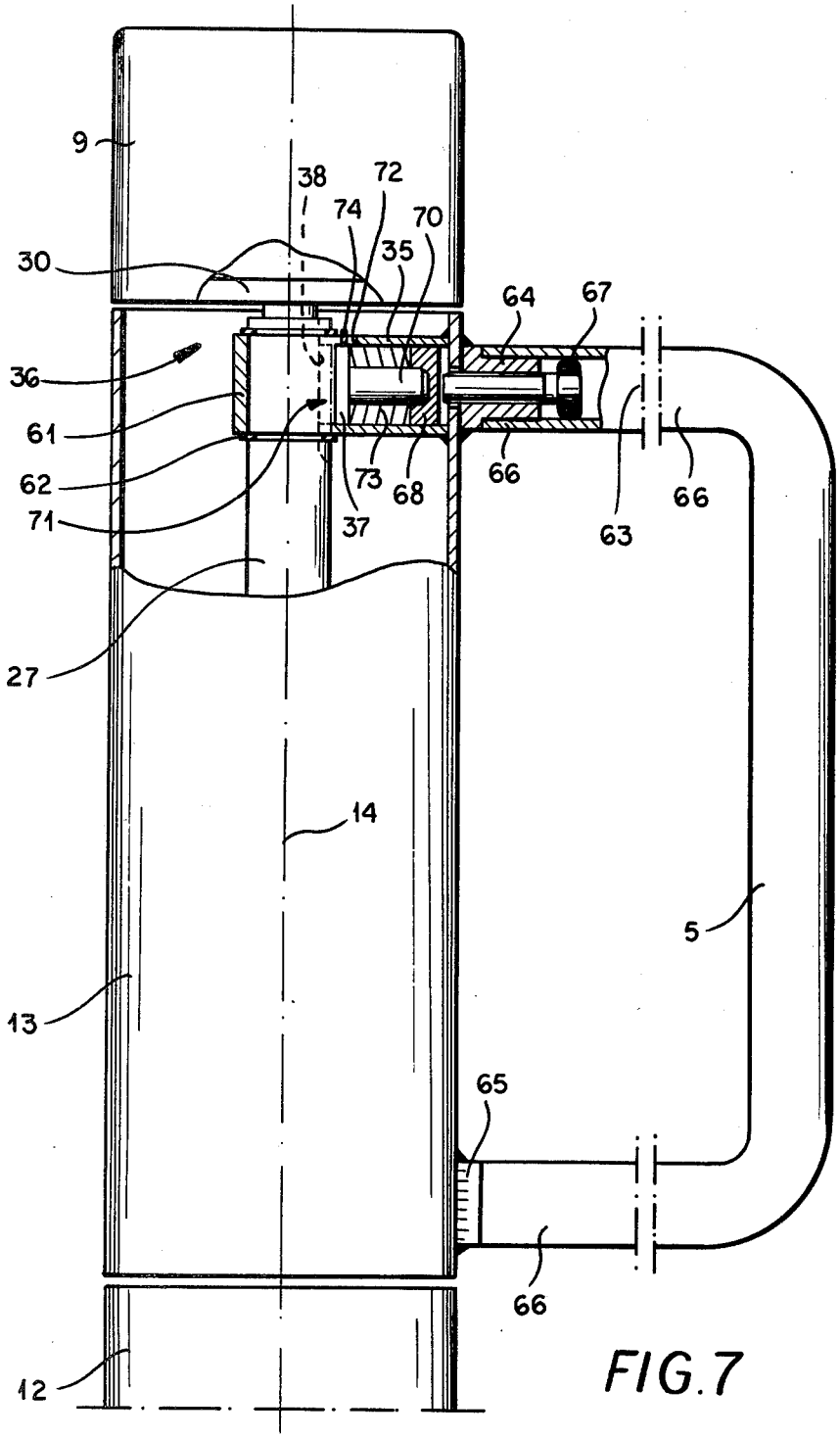
FIG. 7 is a large scale and partly sectional side view of a detail of FIG. 2.
Figure 8:
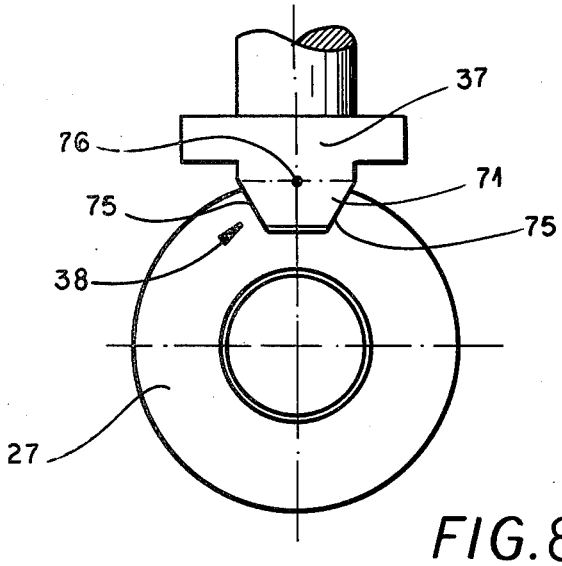
FIG. 8 is an end view of a detail of FIG. 7.

As better shown in FIGS. 7 and 8 the detent arrangement 36 includes a stack of spring washers 73 braced at one end radially inward on the detent element 37 and radially outward on an adjustable abutment 68 that can slide in the part 35. A pair of gate-mount stubs 64 and 65 extend radially from the part 13 and carry the gate 5 which to this end has tubular arms 66 that fit snugly over these stubs 64 and are normally secured thereto by small screws. Inside the upper stub 64 is a screw 67 that can engage through it to bear on the abutment 68 and thereby change the extent of compression of the springs 73. The detent 37 has a radially outwardly projecting pin 70 in the abutment to keep the parts all centered on an axis 63 radial of the axis 14. In addition a pin 74 projecting axially upward from the tooth 37 is received in a slot 72 extending along the axis 63 to preventing the tooth 37 from twisting about this axis 63.

FIG. 8 shows how the tooth 37 has an end 71 formed with a pair of inclined side surfaces 75 perpendicular to an axis 76 lying on the periphery of the shaft 27 and the groove 38 is complementarily formed. Thus if oscillation of the gate 5 relative to the shaft 27 is effected with or resisted by a substantial force the detent 37 will be cammed out of the groove 38 against the force of the springs 73 to allow relative rotation of the shaft 27 and gate 5. The groove 38 is some 40 mm long for considerable force transmission between the shaft 27 and gate 5.

Figure 9:
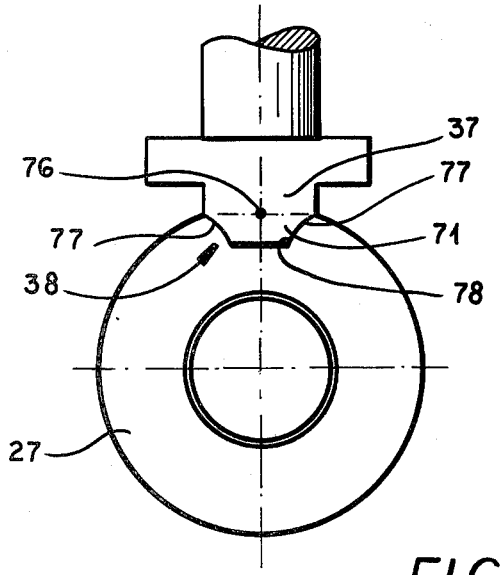
FIG. 9 is a view like FIG. 8 but illustrating a variant of the invention.

In FIG. 9 an arrangement is shown where the tooth 37 has a pair of oppositely outwardly concave faces 77 engaging complenentary faces 78 of the groove 38. This shape of the tooth end 71, like that of FIG. 8, inhibits freezing together of the two parts 71 and 27.

Figure 4:
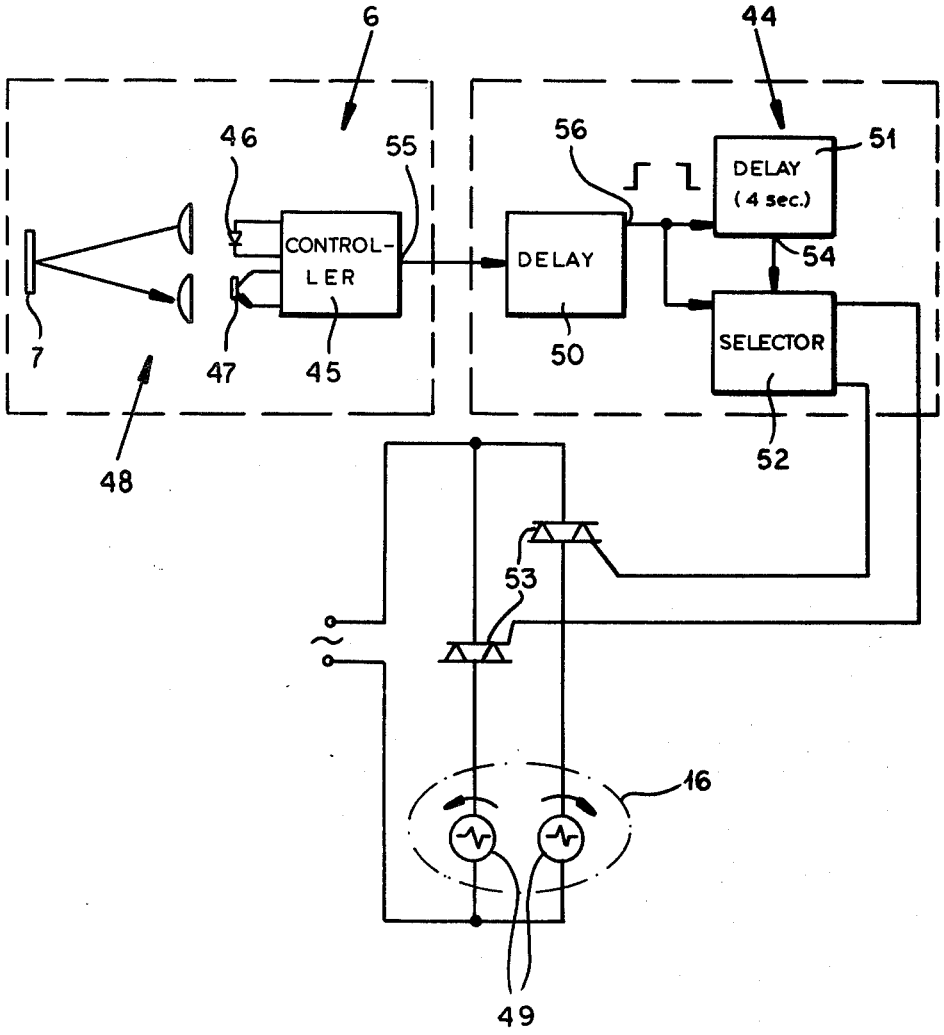
FIG. 4 is an electrical schematic drawing illustrating the invention.

FIG. 4 shows the circuit that controls the motor 16 of the gate arrangement according to this invention. The electric-eye sensor 6 is connected to a delay circuit 44 and thence to the motor 16. It has a light-emitting bulb or diode 47 and a photosensitive cell 46 focused through a lens arrangement 48 on the mirror 7. A controller 45 connected to these devices 46 and 47 has an output 55 connected to a first time-delay unit 50 having an output 56 connected both to another time-delay unit 51 and to a selector 52. The delay 51 in turn has an output 54 connected to the selector 52 which has outputs connected through a pair of triacs 53 to the oppositely effective windings 49 of the motor 16 so that this selector 52 can reverse the motor 16. Normally this control unit 6, 44 is mounted right in the post 3, although it is possible to mount it remotely and only put the photocell 46 and light source 47 at this location.

When the delay 50 receives a digital start signal, normally a shift from binary 1 to binary zero caused by breaking of the beam 2 between the sender 47 and receiver 46, from the output 55 of the controller 45 it feeds it to the selector 52 to set the motor 16 going in one direction. The start signal is simultaneously transmitted to the delay 51 so that after a predetermined interval, say about 4.0 sec, the selector 52 is fed another signal from the output 54 to reverse drive the motor 16, thereby bringing it back to starting position and stopping it.

The output 56 of the unit 50 and the output 54 of the unit 51 have an and function. Thus the time the motor 16 runs is determined by the output 54 and the direction it runs in by the output 56. The delay units 50 and 51 are of the type that can be retriggered or started at any time, even when the delay of either unit 50 or 51 is largely run out, without changing the condition of either output 56 or 54 until the entire delay of the respective unit 50 or 51 has run out again.

Thus assuming the gate takes at most 4 secs to close and open it is possible for a person to break the light beam 2 when the gate is almost closed, that is after it has been closing for 3 sec. This will immediately reverse the motor direction via the direct connection between the output 56 and the selector 52 and will restart the delay 44 so that the motor will operate for the full 4 sec in the opposite direction, ensuring full opening. Thus no matter where in the operation cycle of the gate the eye 6 is tripped the gate will open fully.

Figure 5:
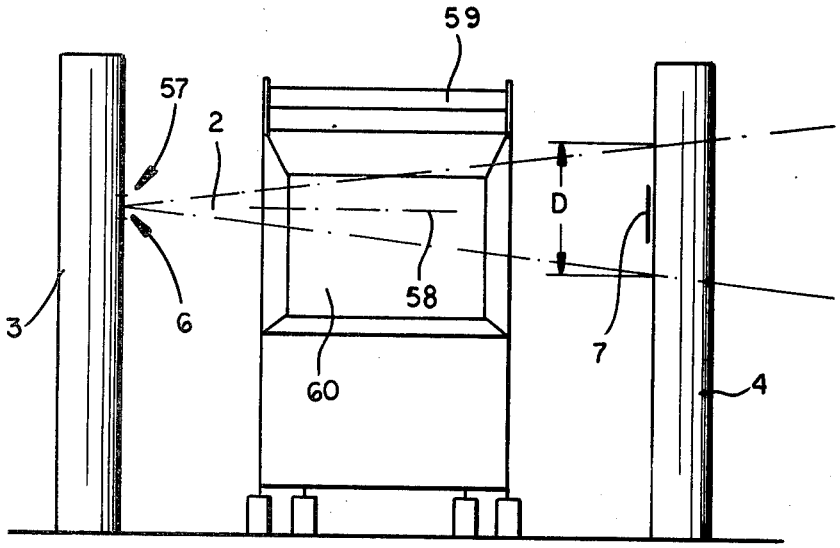
FIG. 5 is an end view of another arrangement according to this invention.
Figure 6:
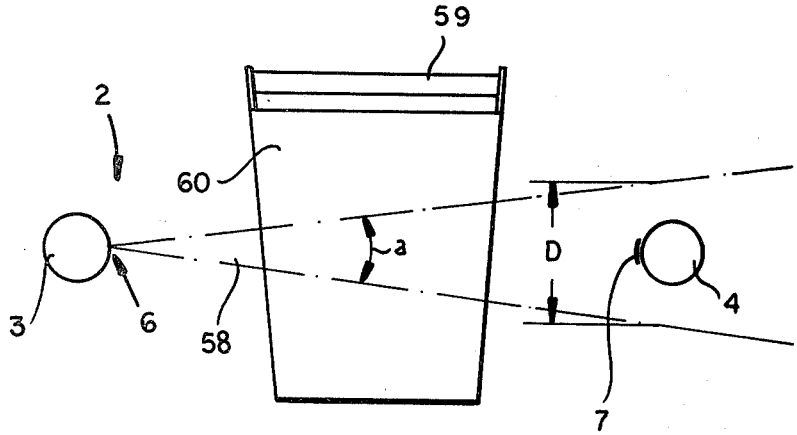
FIG. 6 is a top view of the arrangement of FIG. 5.

FIGS. 5 and 6 illustrate the two posts 3 and 4 to opposite sides of a shopping cart 59 having a front basket portion 60. The post 3 has a hole 57 from which is emitted the light beam 2 which spreads conically to have a diameter D at the reflector 7 on the post 4 of 120 mm. The posts 3 and 4 here have a diameter of 60 mm and are spaced apart by 700 mm, although a spacing as great as 1000 mm is used. The reflector 7 is a metalized plastic foil perpendicular to the horizontal axis 58 of the beam 2 and has a rectangular shape measuring 16 mm horizontally and 100 mm vertically. Thus there will be no problem reflecting enough light for the photocell to respond.

Figure 10:
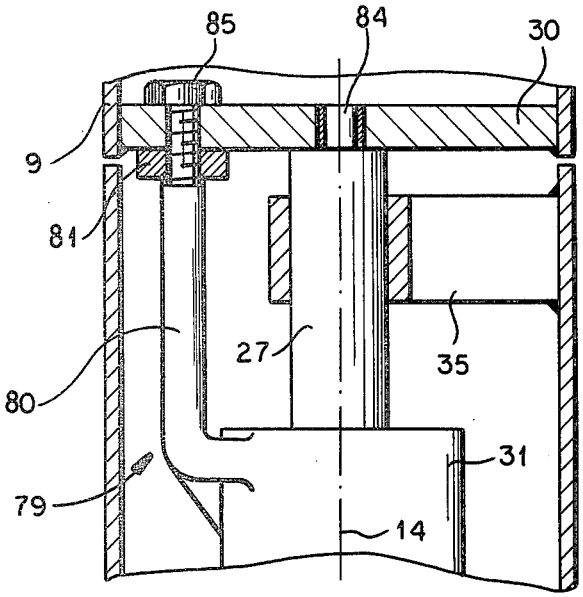
FIGS. 10 and 11 are axial sections through other variants of this invention.
Figure 11:
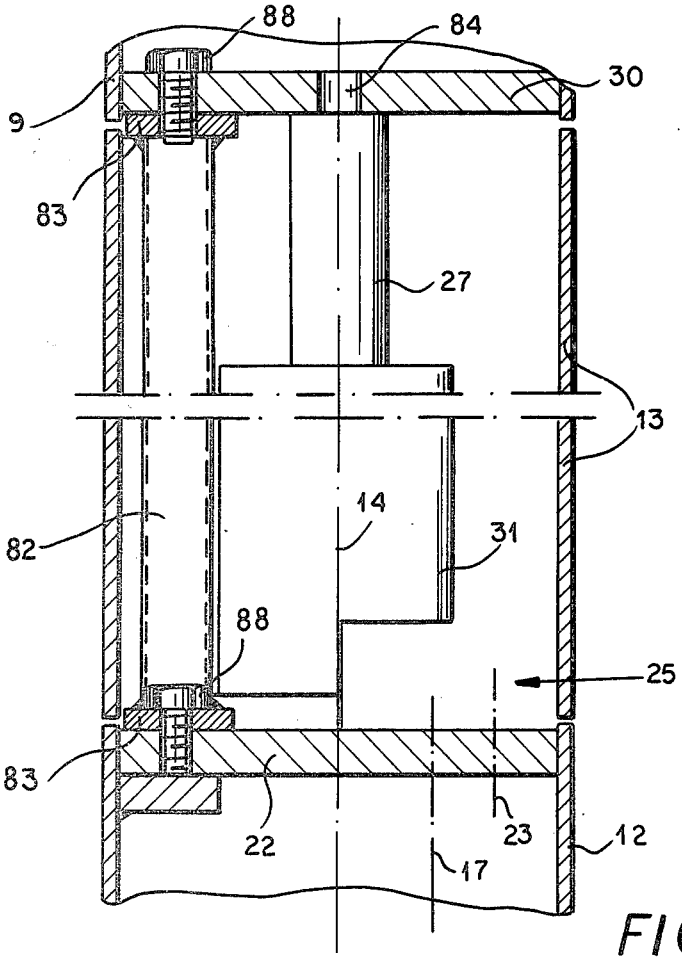

Finally FIG. 10 shows an arrangement wherein an integral iron or aluminum casting 79 forms the support 31 and a bracket arm 80 having an upper flanged end 81 to which the wall 30 of the top part 9 secured by a bolt 85. In FIG. 11 a spacer tube 82 has upper and lower ends formed with flanges 83 secured by bolts 88 to the walls 22 and 30. In all cases the upper part 9 is journaled on the upper end 84 of the shaft 27 as well as connected by the bracket 32, arm 80, or tube 82 so it is fixed relative to the lower part 12.

The arrangement of this invention can be worked on relatively easily. It can be taken apart by first takining off the lens 40, removing the screw 85 through the wall 30, and then lifting off the top part 9. This allows the entire middle part to be lifted up and off the shaft 27, while simultaneously exposing the bolts 86 extending through the wall 22. These bolts 86 can them be unscrewed to allow the entire motor assembly to be taken out. Assembly is the reverse operation.

Thus replacing any part or even all of the parts is quite simple. At the same time the unit has a very nice appearance since none of the screws holding it together are externally visible, which also discourages tampering.

What is claimed is:

1. An automatic gate arrangement for blocking a path, the gate arrangement comprising:

a hollow and tubular lower post part defining an upright post axis and fixed to one side of the path;

an upper end wall transverse to the post axis;

lower fasteners releasably securing the upper end wall to the lower post part to upwardly close same;

a support fixed to the upper end wall and extending upward along the post axis therefrom;

a shaft pivoted in the support about the post axis;

a reversible drive motor fixed on and underneath the upper end wall in the lower post part and having a rotary output extending through the upper end wall;

transmission means between the rotary output and the shaft for converting rotation of the output into oscillation about the post axis of the shaft;

a gate projecting laterally from the post axis;

connecting means securing the gate to the shaft for joint rotation about the post axis unless the gate and shaft are relatively rotated about the post axis with a force exceeding a predetermined maximum force;

control means connected to the motor and including a proximity sensor upstream along the path from the post parts for operating the motor and oscillating the gate when a person is detected by the sensor;

a hollow and tubular middle post part above the lower post part, centered on the post axis in axial alignment with the lower post part, and carried on the gate for pivoting therewith about the post axis;

a hollow and tubular upper post part above the middle post part and centered on the post axis in axial alignment with the lower and middle parts;

rigid strut fixed to the lower post part and support; and lower fasteners securing the upper post part to the strut for relatively fixing the upper and lower post parts together.

2. The automatic gate arrangement defined in claim 1 wherein the support has a lower end provided with a flange secured to the upper end wall.

3. The automatic gate arrangement defined in claim 1 wherein the middle part has a lower web formed with a throughgoing hole fitting snugly over the shaft and an upper part similarly fitted over the shaft above the lower web and being rotationally connected thereto by the connecting means.

4. The automatic gate arrangement defined in claim 1 wherein the strut is a bracket having a lower bracket end bolted to the support and an upper bracket end connected by the upper fasteners to the upper part.

5. The automatic gate arrangement defined in claim 1 whereinthe strut is an arm unitarily formed with the support.

6. The automatic gate arrangement defined in claim 1 wherein the strut is a bracket having a lower bracket end bolted to the upper end wall and an upper bracket end connected by the upper fasteners to the upper part.

7. The automatic gate arrangement defined in claim 1 wherein the upper part has a removable top wall.

8. The automatic gate arrangement defined in claim 7 wherein the upper part is at least partially transparent and is provided with a lamp for internal illumination.

9. The automatic gate arrangement defined in claim 1 wherein the transmission means includes a lever block projecting radially from the shaft and having a slot open radially outward from the post axis; and an eccentric crank on the rotary output engaged in the slot.

10. The automatic gate arrangement defined in claim 9, further comprising an abutment radially fixed relative to the motor output and engageable by same in oscillatory end positions thereof.

11. The automatic gate arrangement defined in claim 10 wherein the motor output rotates about a motor axis generally parallel to the post axis and the eccentric is centered on an eccentric axis parallel to and offset from the motor and post axes, the eccentric axis forming substantially perpendicular planes with the motor and post axes in the end positions.

12. The automatic gate arrangement defined in claim 11 wherein in the end positions of the eccentric it bears radially of the post axis on the abutment.

13. The automatic gate arrangement defined in claim 12 wherein the shaft has a lower-end projection forming the abutment.

14. The automatic gate arrangment defined in claim 10, further comprising means for releasably retaining the eccentric in the end positions with spring force.

15. The automatic gate arrangement defined in claim 9 wherein the shaft is shaped to receive the lever block in any of a plurality of angularly offset positions, the block including a block fastener to fix itself on the shaft in any of the offset positions.

16. The automatic gate arrangement defined in claim 1 wherein the motor is of the nonshorting stoppable type.

17. The automatic gate arrangement defined in claim 1 wherein the connecting means includes a detent displaceable radially but not angularly on the middle part relative to the post axis toward and away from the shaft;

spring means radially urging the detent toward the shaft with a predetermined biasing force; and a formation on the shaft interfittable with the detent, the formation and detent inhibiting rotation of the shaft relative to the middle part with a force generally proportional to the biasing force.

18. The automatic gate arrangement defined in claim 17 wherein the middle part is formed with a bore extending radially of the post axis, the detent being displaceable along the bore.

19. The automatic gate arrangement defined in claim 18 wherein the middle part has at least one stub extending radially of the post axis and the gate has a tube arm fitted over the stub, the bore being formed in the stub.

20. The automatic gate arrangement defined in claim 19 wherein the spring means includes an abutment in the bore radially displaceable and outside the detent;

at least one spring braced radially inward against the detent and radially outward against the detent; and a screw extending through the stub and bearing radially inward on the abutment.

21. The automatic gate arrangement defined in claim 1 wherein the proximity sensor includes means including a light source directed across the path from one lateral side thereof for casting a beam across the path;

a reflector facing across the path from the other lateral side thereof and intercepting and reflecting the beam of the light source; and a light sensor on the one side of the path receiving the reflected beam.

22. The automatic gate arrangement defined in claim 1 wherein the parts all are substantially concentric, coaxial, and aligned.

* * * * *